US008276579B2

(12) United States Patent
Bruckner

(10) Patent No.: US 8,276,579 B2
(45) Date of Patent: Oct. 2, 2012

(54) HOT-AIR FURNACE MODULE AND HOT-AIR FURNACE

(75) Inventor: Dietmar Bruckner, Gaeufelden (DE)

(73) Assignee: Eisenmann AG (DE)

( * ) Notice: Subject to any disclaimer, the term of this patent is extended or adjusted under 35 U.S.C. 154(b) by 685 days.

(21) Appl. No.: 12/377,090

(22) PCT Filed: Jul. 28, 2007

(86) PCT No.: PCT/EP2007/006700

§ 371 (c)(1),
(2), (4) Date: May 7, 2009

(87) PCT Pub. No.: WO2008/017394

PCT Pub. Date: Feb. 14, 2008

(65) Prior Publication Data

US 2010/0175679 A1 Jul. 15, 2010

(30) Foreign Application Priority Data

Aug. 11, 2006 (DE) ..... 10 2006 037 703

(51) Int. Cl.
*F27B 9/10* (2006.01)

(52) U.S. Cl. ..... 126/112; 126/106; 126/104 A

(58) Field of Classification Search ..... 126/112, 126/106, 104 A, 103, 105; 432/145, 152
See application file for complete search history.

(56) References Cited

U.S. PATENT DOCUMENTS 5,131,841 A 7/1992 Smith et al.
2010/0175679 A1* 7/2010 Bruckner ..... 126/112

FOREIGN PATENT DOCUMENTS

EP 0 419 213 B1 3/1991
EP 0 878 680 A1 11/1998
US 31 38 282 C2 4/1983

* cited by examiner

*Primary Examiner* — Alfred Basichas
(74) *Attorney, Agent, or Firm* — Factor Intellectual Property Law Group, Ltd.

(57) ABSTRACT

The invention relates to a hot-air furnace module having a furnace space, which is at least partially delimited by walls and is assigned an air-delivery device for producing an airstream and a heat-transfer device for heating the airstream. According to the invention, an incoming-air channel is provided, which is formed between the air-feed device and the furnace space for guiding the airstream delivered by the air-feed device and which is provided with first and second throttle means, which are arranged at a distance from one another in the direction of flow and are intended to even out the airstream before it flows through the furnace space. Furthermore, according to the invention a hot-air furnace is formed from hot-air furnace modules which are rotated through 180 degrees with respect to one another and are in communication with one another.

21 Claims, 3 Drawing Sheets

HOT-AIR FURNACE MODULE AND HOT-AIR FURNACE

RELATED APPLICATIONS

This application claims the filing benefit of International Patent Application No. PCT/EP2007/006700, filed Jul. 28, 2007, which claims the filing benefit of German Patent Application No. 10 2006 037 703.6 filed Aug. 11, 2006, the contents of all of which are incorporated herein by reference.

TECHNICAL FIELD

The invention relates to a hot-air furnace module having a furnace chamber which is at least partially delimited by walls and with which there is associated an air-delivery device for producing an airstream and also a heat-transfer device for heating the airstream, and the invention also relates to a hot-air furnace which is formed from hot-air furnace modules.

BACKGROUND OF THE INVENTION

A hot-air furnace, which is known from the market, for industrial applications, for example for the thermal oxidation of plastic fibres, has an air-delivery device which is designed as a blower and is intended to produce an airstream. The airstream is guided past a heat-transfer device, for example electrically operated heating bars or a heat-exchanger heated indirectly with thermal oil, and is heated. The heated airstream is then directed into a furnace chamber which is delimited by walls and in which the material which is to be thermally treated is located. The walls of the furnace chamber bring about a limitation of the cross-section through which the heated airstream is able to flow and thus ensure a concentrated introduction of heat into the material to be treated. The known hot-air furnace can be assembled, by the modular method of construction, from a plurality of hot-air furnace modules which may be prefabricated as subassemblies and which are connected to one another at the site at which the hot-air furnace is to be used. In certain cases, such as, in particular, in the manufacture of carbon fibres by oxidising plastic fibres, a uniform action on the material to be treated is of decisive importance, and this, in turn, presupposes precise, defined airflows. Basically, the fact is: the better the airflow distribution, the better the result.

The present invention is directed to resolving these and other matters.

SUMMARY OF THE INVENTION

An object of the invention consists in providing a hot-air furnace module, and also a hot-air furnace, which permit more effective and more precise thermal treatment of materials in the furnace chamber.

This object may be achieved by means of a hot-air furnace module having a furnace chamber which is at least partially delimited by walls and with which there is associated an air-delivery device for producing an airstream and also a heat-transfer device for heating the airstream, wherein an incoming-air duct is provided which is constructed between the air-delivery device and the furnace chamber for directing the airstream delivered in one direction of flow by the air-delivery device and which is provided with first and second throttling means which are arranged at a distance from one another in the direction of flow and are intended to even out the airstream before it flows through the furnace chamber and also by means of a hot-air furnace having hot-air furnace modules wherein the hot-air furnace modules that are arranged in an adjacent manner in each case are oriented in a manner rotated by 180 degrees in relation to one another and are connected to one another in a communicating manner.

According to a first aspect of the invention, an incoming-air duct is provided which is constructed between the air-delivery device and the furnace chamber for directing the airstream delivered by the air-delivery device in one direction of flow, and which is provided with first and second throttling means which are arranged at a distance from one another in the direction of flow and are intended to even out the airstream before it flows through the furnace chamber (20). By means of the infeed duct between the air-delivery device and the furnace chamber, it is possible to obtain stabilisation of the airstream. A turbulent airstream flow which is present in the region of the air-delivery device becomes less turbulent with increasing remoteness from said device and with suitable configuration of the incoming-air duct. In order to achieve additional stabilisation of the airstream, at least two throttling means are provided, which lie one behind another at a distance in that cross-section of the incoming-air duct through which flow can take place, and are thus able, if configured in a suitable manner, to cause a significantly less turbulent flow to be present behind the particular throttling device than in front of it, in the direction of flow.

As a result of the series connection, according to the invention, of two throttling means, it is possible to achieve considerable stabilisation of the airflow. By means of an airflow with low turbulences, it is possible to achieve a particularly uniform transfer of heat to the material which is to be treated thermally in the furnace chamber. Greater temperature gradients, which could lead to unwanted, non-uniform thermal treatment of the material in the furnace chamber, are avoided.

Because of the low turbulences in the airflow within the furnace chamber, the excitation of vibrations in the material located in the furnace chamber is avoided, so that it is possible to thermally treat even delicate, in particular brittle, materials having a small cross-section, without the risk of breakage.

In a refinement of the invention, the second throttling means, which is associated with the incoming-air duct, is constructed as a wall of the furnace chamber. By this means, the second throttling means also acquires a delimiting function in addition to the stabilising function for the airstream. Said throttling means preferably spans the entire cross-section of the furnace chamber and thus completely replaces one of the walls, which are typically of flat design, of said furnace chamber. By configuring the throttling means with a surface area which corresponds to the cross-section of the furnace chamber, it is additionally possible to obtain a particularly homogeneous distribution of the airstream within said furnace chamber. This contributes considerably to the sought-after low-turbulence or turbulence-free airstream within the furnace chamber.

In one preferred form of embodiment, at least one throttling means is constructed as a wall which has clearances passing through it, in particular as a perforated metal sheet. Bores and/or slots may preferably be provided as the clearances. The clearances are arranged on the surface area with equal or unequal spacing and have uniform or varying geometries. A throttling means of this kind may be constructed, in particular, in the form of wire-mesh fabric consisting of a large number of wires arranged in a grid-like manner, or in the form of perforated metal sheet having a large number of bores.

It is expedient if the clearances in the throttling means, which throttling means are arranged at a distance from one another, are constructed in such a way that said throttling means have flow-resistances for the airstream which differ, at least in some cases. By this means it is possible to cause the airflow to initially be stabilised only partially at the first throttling means, without this resulting in the building-up of an excessively high flow-resistance which would have a negative effect on the air-volume stream which is delivered, as a whole, into the furnace chamber. In the second throttling means, which is connected downstream in a serial manner, the airstream, which has already been stabilised to a great extent by the first throttling means and the infeed duct, is additionally stabilised and then passes into the furnace chamber as a low-turbulence or turbulence-free or laminar airflow.

The first throttling means preferably has a lower flow-resistance than the second throttling means which is connected downstream in the direction of flow. The air-volume stream, which may optionally be highly turbulent, is first of all stabilised to a considerable extent by the first throttling means which has the lower flow-resistance. By means of the second throttling means, further stabilisation takes place before the air-volume stream passes into the furnace chamber. Under these circumstances, it is necessary, for a low-turbulence or turbulence-free air-volume stream, to accept a higher flow-resistance of the second throttling means in order to achieve the most complete stabilisation possible of said air-volume stream.

In one preferred form of embodiment, the first throttling means is constructed with a clear cross-section of between 20 and 30 percent of the surface area. Here, the "clear cross-section" denotes the relationship between surface areas of the clearances at the throttling means through which airstream is able to pass, and closed surface areas of the throttling means which constitute an obstacle to the airstream. In the case of a clear cross-section of at least 20 percent, therefore, referred to a total surface area of the throttling means, which may be designed, for example, as a rectangular sheet-metal panel, 20 percent of the surface area is perforated by clearances. Under these circumstances, said clearances may be evenly distributed with a fixed spacing and a fixed geometry. However, clearances in the edge regions of the throttling means may also have a different geometry and/or spacing from the clearances in the centre of the surface area of said throttling means.

In one preferred form of embodiment, the second throttling means is constructed with a clear cross-section of between 5 percent and 10 percent of the surface area. It is thereby possible to obtain intensive stabilisation of turbulences immediately before the airstream passes into the furnace chamber, so that a low-turbulence, and preferably a turbulence-free, laminar flow can develop within said furnace chamber.

In a further refinement of the invention, at least one of the throttling means is provided with air-directing means which are constructed as walls which are oriented orthogonally to a surface of said throttling means through which flow can take place. The dividing-up of the airstream into individual flows is thereby maintained, at least over a certain flow path, behind the clearances provided in the throttling means, referred to the direction of flow. Because of the walls on the throttling means, the individual flows do not mingle immediately behind the throttling means. On the contrary, the individual flows remain separate from one another, as a result of which it is possible to obtain advantageous stabilisation of the airflow. The walls of the air-directing means may have a height which is greater, by a multiple, than a thickness of the throttling means. The walls are preferably arranged in such a way that each airflow which passes out of the clearances in the throttling means is separated from an airflow from an adjacent clearance. The walls may, in particular, be manufactured from thin-walled sheet metal and may be welded to the throttling means.

In one preferred form of embodiment of the invention, a number of throttling means, which are provided, in particular, with air-directing means, are arranged immediately one behind another in the direction of flow, and form a throttling unit. By arranging a number of throttling means immediately one behind another, it is possible to provide a compact throttling unit which is able to bring about an advantageous stabilisation of the airflow. Under these circumstances, provision is preferably made for at least one of the throttling means which are arranged immediately one behind another to be provided with air-directing means.

In a further refinement of the invention, there may be provided a used-air duct which is connected downstream of the furnace chamber in the direction of flow and which is intended for at least partially feeding back to the air-delivery device the airstream which has been directed through the furnace chamber. It is thereby possible to obtain efficient utilisation of the kinetic energy and internal energy introduced into the airstream by the air-delivery device and heat-transfer device respectively. Under these circumstances, the airstream, which has already been heated and is in motion, flows through the furnace chamber and is fed to the air-delivery device again in a circular motion. It is thereby necessary, for a constant temperature in the furnace chamber, to replace the heat which has been radiated away through the walls of the furnace chamber and of the incoming-air and used-air ducts. In addition, it is necessary to heat up fresh air which has been fed in through the sluices, and to heat the plastic fibres to be oxidised, under which circumstances the water contained in the plastic fibres has to be evaporated at the beginning of the oxidation operation.

It is expedient if at least one throttling means for the airstream is provided in the used-air duct. A defined flow-resistance for the airstream after it has flowed through the furnace chamber is thereby ensured. This prevents the airstream dividing up, even in the furnace chamber, into two or more streams, which each flow away in the direction of least resistance, something which would give rise to unwanted disturbance of the airstream.

In one preferred form of embodiment, a first throttling means which is associated with the used-air duct is constructed as a wall of the furnace chamber. This ensures a constant flow-resistance over the entire cross-section of the furnace chamber, so that local flowing-away of the airstream fed into said furnace chamber can be at least substantially avoided.

It is expedient if the throttling means which are designed as walls of the furnace chamber are arranged in an opposed manner. This promotes a low-turbulence or laminar flow in the furnace chamber, since the airstream passing into said furnace chamber does not have to be rerouted until it passes out of the latter. That is to say, the vector of motion for an air particle which passes into the furnace chamber is substantially parallel to the vector of motion of said air particle on passing out of said furnace chamber.

In a further refinement of the invention, at least one separating device for decoupling airstreams in the furnace chamber is provided between the walls which are designed as throttling means. The separating device extends in the direction normal to the faces of the throttling means, which throttling means are arranged in an opposed manner, and is perforated only by narrow slots for passing through filament-directing bars and thus permits extensive separating-up of the furnace chamber into two regions which lie parallel and which are substantially independent in terms of fluidics. This is particularly advantageous if the material which is to be thermally treated is moved within the furnace chamber, for example for a continuous treatment process. By means of the separating device, it is possible, for example, for material to be conveyed through the furnace chamber in different directions without the airflows affecting one another.

In one preferred form of embodiment, the throttling means are arranged in the incoming-air duct and/or the used-air duct at an angle to one another, in particular an angle of 90 degrees. As a result of such rerouting of the airstream, it is possible to achieve a compact configuration of the hot-air furnace module, without having to accept considerable disturbance of the airstream. This also applies to the arrangement of the air-delivery device, the incoming-air duct and the walls designed as throttling means, which are oriented, in advantageous manner, in such a way that an airstream which is emitted by the air-delivery device is able to flow in a parallel direction but in counter-current to an airstream within the furnace chamber.

In one preferred form of embodiment, provision is made for the air-delivery device and the throttling means to be constructed in such a way that there can be developed, within the furnace chamber, a laminar airflow with a substantially uniform velocity distribution, in particular with a maximum velocity variation over the cross-section of the furnace chamber of +/−10 percent at a velocity of 1.5 m/s. It is thereby possible, for example, to carry out within the furnace chamber an oxidation process in which thin plastic fibres are oxidised by thermal oxidation to form carbon fibres, under which circumstances considerable embrittlement of the plastic fibres occurs. If a turbulent flow were present, the plastic fibres, which are typically conveyed through the furnace chamber at constant velocity, might be induced to vibrate and might break. With a laminar flow of the airstream within the furnace chamber, the risk of breakage of the plastic fibres is considerably reduced. In order to ensure particularly uniform thermal treatment of the material, the variation in the velocity of the airstream in all regions of the furnace chamber is limited to +/−10 percent. This ensures that the airstream flowing past the material does not cause any unevenly distributed introduction of energy into the material, such as might be the case in the event of different velocities within the airstream.

In a further refinement of the invention, there is provided, at least one wall region of the furnace chamber, a sluice device which is constructed for continuously feeding-in and/or conducting-away an endless material which is to be thermally treated in the furnace chamber. Said sluice device is configured in such a way that a material in the form of a strand or filament can be fed into or out of the furnace chamber. Under these circumstances, provision is made for it to be possible for fresh air to flow into the furnace chamber afterwards through the sluice devices. For this purpose, part of the quantity of air present in the furnace chamber is conducted away out of said furnace chamber by a used-air installation and is replaced by the fresh air that flows after it. The furnace chamber is thereby operated at a lower pressure, compared with the environment of the hot-air furnace, as a result of which it is possible to avoid uncontrolled flowing-away of air out of the hot-air furnace. This is of particular interest, since the used air may be laden with pollutants because of the oxidation processes taking place within the furnace chamber. The used-air installation is therefore equipped with one or more cleaning stages, in particular with a thermal used-gas aftertreatment installation, for the purpose of removing pollutants from the used air.

In one preferred form of embodiment, provision is made for the fresh air flowing in to be pre-heated in the region of the sluices, in particular in a heat-exchanging process with the used air sucked out. This permits particularly efficient operation of the hot-air furnace module.

According to another aspect of the invention, a hot-air furnace having hot-air furnace modules according to one of claims 1 to 18 is provided, in which hot-air furnace modules which are arranged in an adjacent manner in each case are oriented in a manner rotated by 180 degrees in relation to one another and are connected to one another in a communicating manner. The modular method of assembling the hot-air furnace makes it possible to obtain cost-effective series production of the individual parts from which the individual hot-air furnace modules are assembled. This arrangement of the hot-air furnace modules makes it possible to bring about an advantageous airstream, since the air-delivery devices which are arranged in an opposed manner prevent one-sided extraction of the airstream from the furnace chamber by suction.

In one form of embodiment of the hot-air furnace according to the invention, provision is made for said furnace to be assembled from six hot-air furnace modules and to have a length of the sides of 15 m×8.6 m×4.6 m. The hot-air furnace modules have a length of the sides of 2.5 m×8.6 m×4.6 m and can thus be transported without using a special heavy transporter.

In one preferred form of embodiment, the hot-air furnace modules delimit a common, uninterrupted furnace chamber. It is thereby possible, by arranging a number of hot-air furnace modules in a row, to erect a hot-air furnace with a furnace chamber of almost any desired length. In the abovementioned form of embodiment of the invention, provision is made for a length of 15 m for the furnace chamber and the height of the latter is 2 m, while the width is 4.7 m. Provided on the longitudinal sides of the furnace chamber at the ends in each case are sluice devices which permit continuous charging and discharging of material. Under these circumstances, the full length of 15 m is available to the material for the thermal treatment process.

It is expedient if the used-air ducts form a distributor chamber which is arranged downstream of the furnace chamber in the direction of flow and which is intended to provide a preferably equal distribution of airstreams from the furnace chamber to the air-delivery devices of the at least two adjacently arranged hot-air furnace modules. The common distributor chamber makes it possible to realise the splitting-up of the airstream flowing through the furnace chamber into at least two branches of the stream. These branches of the airstream are guided past the heat-transfer devices of the adjacently arranged hot-air furnace modules and are delivered into the respective incoming-air ducts and the common furnace chamber again by the respective air-delivery devices. As a result of this, it is possible to ensure that a uniform temperature prevails in the furnace chamber as a whole, even if the heat-transfer devices or the air-delivery devices have differing degrees of efficiency.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
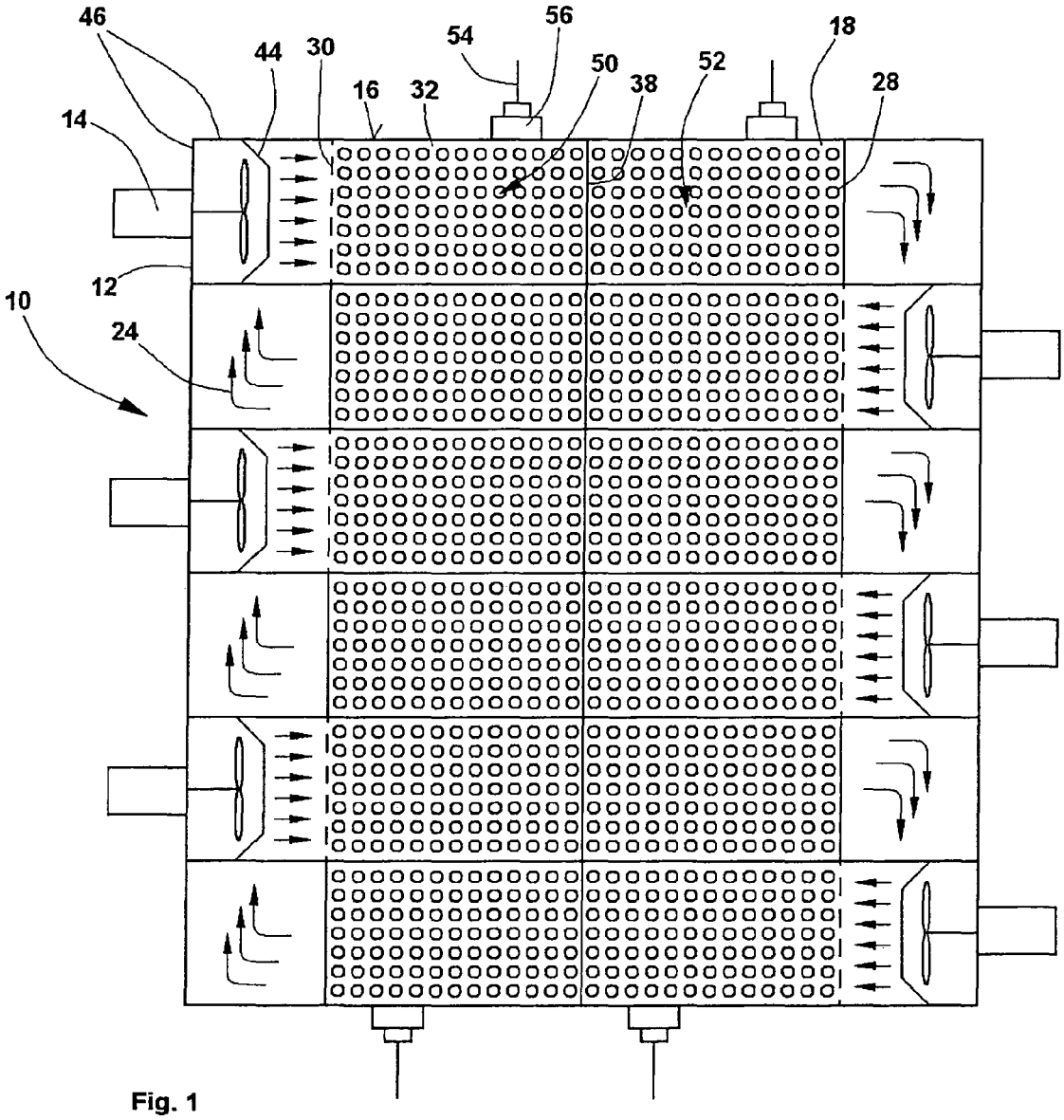
FIG. 1 shows, in plan view, a diagrammatic representation of a hot-air furnace according to the invention which is assembled from a number of hot-air furnace modules.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

A hot-air furnace 10 which is represented in FIG. 1 is assembled from a plurality of hot-air furnace modules 12 which are arranged side by side in a row and form a common furnace chamber 20 which is uninterrupted in the direction in which they are in said side-by-side arrangement in a row. The hot-air furnace modules 12 are oriented, in relation to one another, so as to each be rotated by 180 degrees relative to one another in relation to an axis of symmetry which is not represented but which is normal to the plane of the representation in FIG. 1. Each of the hot-air furnace modules 12 has a base surface area of 2.5 m×8.6 m and also a height of 4.6 m, which is represented in FIG. 2.

The furnace chamber 20, which is delimited by walls 16, 18, is of cubic configuration. Under these circumstances, vertically oriented walls 16 are of closed design, while horizontally oriented walls 18 are designed as perforated metal sheets having a large number of clearances 28 which are arranged in a regular manner and are provided with the same geometry. Because of the clearances 28, the horizontally oriented walls 18 allow an airstream to pass through. Under these circumstances, a flow-resistance to the airstream which is passing through is determined by the clear cross-section, that is to say by the ratio of the surface area of the clearances 28 to the total surface area of the wall 18 as a whole. In the case of the horizontally oriented walls 18, a clear cross-section of 10 percent is advantageously chosen, so that the clearances 28 take up only 1/10 of the total surface area of the wall 18.

Provided on the hot-air furnace modules 12 at the end face in each case is an air-delivery device which is designed as a blower 14 and which permits delivery of the air contained in the hot-air furnace module 12.

Figure 2:
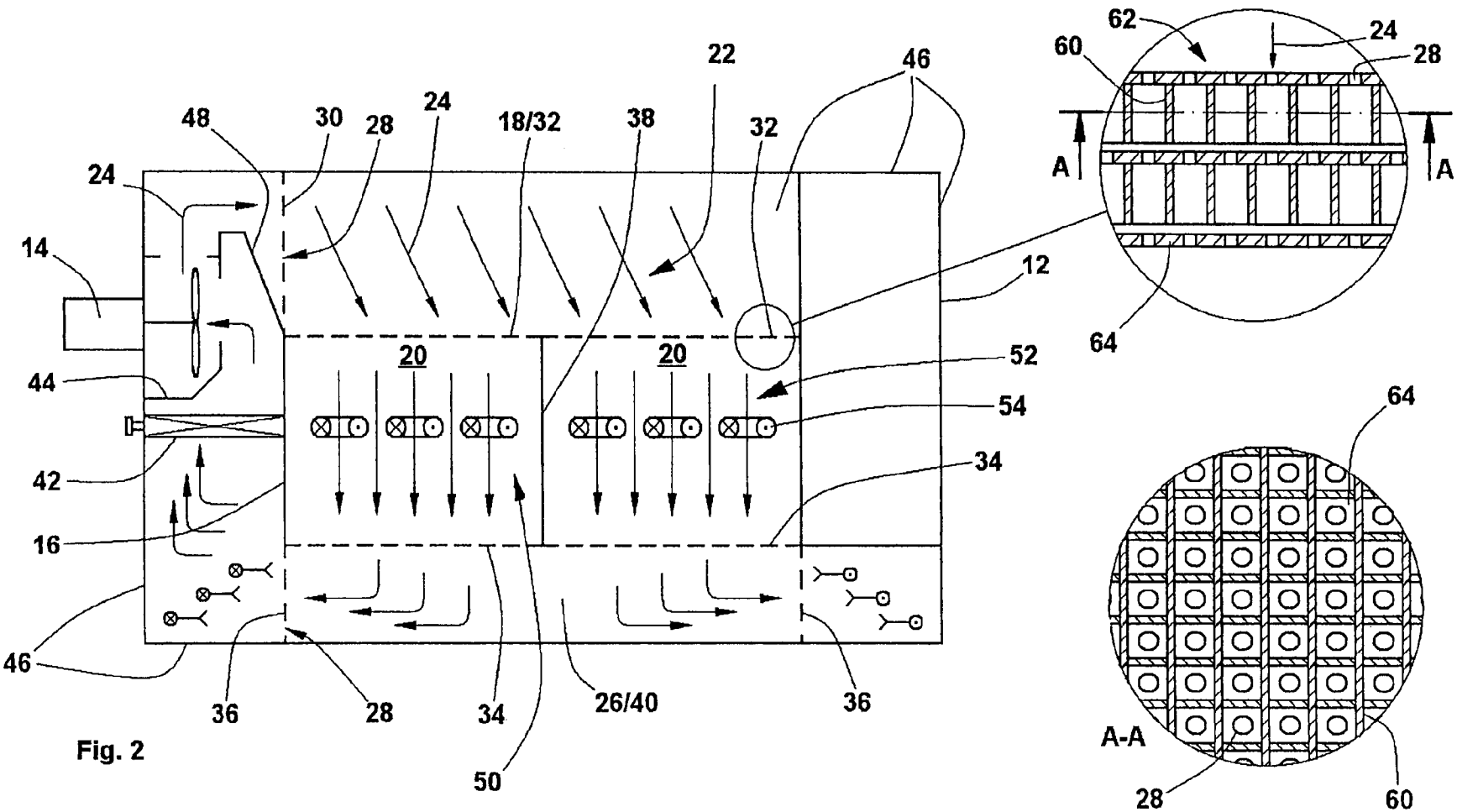
FIG. 2 shows a diagrammatic side view of one of the hot-air furnace modules according to FIG. 1.

As is represented in greater detail in FIG. 2, the blower 14 is fitted at the end face in an upper region of the hot-air furnace module 12 and has a blower motor and also a rotor which is secured in position on a motor shaft belonging to the blower motor and is arranged in a blower box 44. As a result of a rotational movement of the motor shaft, the blower is able to suck in air from a lower region, which will be described in greater detail below, of the hot-air furnace module 12, and is able to emit the air upwards out of the blower box 44 in the form of an airstream with a predeterminable flow velocity. Under these circumstances, the blower box 44 serves to canalise the airstream delivered by the blower 14. Behind the blower box 44, referred to the direction of flow 24, said airstream is guided in an incoming-air duct 22 which is substantially delimited by external walls 46 of the hot-air furnace module 12 and also by a metal baffle plate 48. A first throttling device 30, which has a clear cross-section of about 30 percent, is provided in the incoming-air duct 22 as a first throttling means. The airstream is dammed up at the first throttling device 30 and penetrates, through the clearances 28, into that region of the incoming-air duct 22 which lies behind it. As a result of the damming-up of the airstream and the orderly passage through the first throttling device 30, turbulences which have been generated by the blower 14 are almost completely eliminated. Although it is possible for new turbulences to occur when the airstream passes through the first throttling device 30, these are nevertheless considerably lower, if the flow velocity or volume flow of the airstream are chosen in a suitable manner, than in the region of the incoming-air duct 22 in front of the first throttling device 30.

The airstream then penetrates the cover, which is designed as a second throttling device 32, of the furnace chamber 20, which cover is designed as the second throttling means. Since the second throttling device 32 has a clear cross-section of about 10 percent, a uniform distribution of the molecules of air contained in the airstream comes about because of the damming-up of said airstream between the first and second throttling devices 30, 32, so that the same quantity of air is able to pass through the clearances 28 at all points on the second throttling device 32. The airstream has now penetrated into the furnace chamber 20 and flows in the vertical direction, in a laminar manner, from the second throttling device 32 towards a third throttling device 34 which is designed as the third throttling means. The furnace chamber 20 is subdivided, by a separating device 38 which is extended between the second and third throttling devices 32, 34, into a first furnace-chamber region 50 and a second furnace-chamber region 52. The separating device 38, which is interrupted by narrow slots for passing through filament-directing bars, prevents an unwanted interaction of the airflows between the first and second furnace-chamber regions 50, 52. This is of interest for the purpose of avoiding unwanted turbulences in the laminar airstream which result from the furnace-chamber regions 50, 52 affecting one another.

The throttling devices 30 to 34 described above, and also a fourth throttling device 36, may, in one preferred form of embodiment of the invention, be designed as throttling units 62, which are represented in the detail enlargement in FIG. 2 in an exemplary manner with the aid of the throttling device 34. The throttling units 62 are assembled from a number of perforated metal sheets 64 which are arranged immediately one behind another, referred to the direction of flow 24, air-directing means 60 being associated with the two upper perforated metal sheets 64. The air-directing means 60 are arranged behind the perforated metal sheets 64, referred to the direction of flow 24. As is represented in greater detail in the section A-A, they are arranged in a grid-like manner around the individual clearances 28 in the perforated metal sheets 64, and have a height which corresponds to a multiple of the thickness of said sheets 64. The air-directing means 60 are manufactured from narrow sheet-metal strips which are each provided, in the grid-size of the clearances, with slot-like notches, said notches making it possible to join the sheet-metal strips together in opposite directions and to thus obtain the grid-like arrangement.

Indicated in outline in FIG. 2 is a strand-shaped material 54 which is conveyed within each of the furnace-chamber regions 50, 52. As is represented in greater detail in FIG. 3, the material 54 is introduced into the furnace chamber 20 by a sluice device 56 and is rerouted a number of times by means of rerouting systems 58, so that the volume of the furnace chamber 20 can advantageously be fully utilised and the duration of dwell for the thermal treatment of the material 54 is increased. The material is then removed from the furnace chamber 20 again by a second sluice device 56 and can be fed to another processing system.

On an underside, the furnace chamber 20 is delimited, as shown in FIG. 2, by the third throttling device 34 which, in that form of embodiment of the hot-air furnace module 12 which is represented, has the same clear cross-section as the second throttling device 32. The third throttling device 34 prevents uncontrolled flowing-away of the airstream, and thereby ensures a low-turbulence or laminar airstream even in the lower region of the furnace chamber 20. Beginning underneath the third throttling device 34 is a used-air duct 26 which is intended for feeding the airstream back to the blower 14. In that form of embodiment of the hot-air furnace module 12 which is represented in FIG. 2, provision is made for the possibility of guiding the airstream both to the blower 14 and to a blower belonging to a hot-air furnace module which is arranged in a manner rotated by 180 degrees but which is not represented. The region of the used-air duct 26 below the third perforated metal sheet 34 thereby serves as a distributor chamber for the airstream. Irrespective of which blower the airstream flows away to, said airstream has to pass through the fourth throttling device 36 before reaching said blower. The fourth throttling device 36 serves to cause the airstream to flow to the respective blower in an orderly manner.

On the way to the blower 14, the airstream passes through a heat-transfer device 42, which is designed as a heat-exchanger which is heated indirectly with thermal oil and which heats the airstream to the target temperature which is desired for the furnace chamber 20. In the case of the present hot-air furnace module 10, it is possible, for example, to preset a target temperature in the furnace chamber 20 of 200 degrees to, in particular, 280 degrees Celsius.

Figure 3:
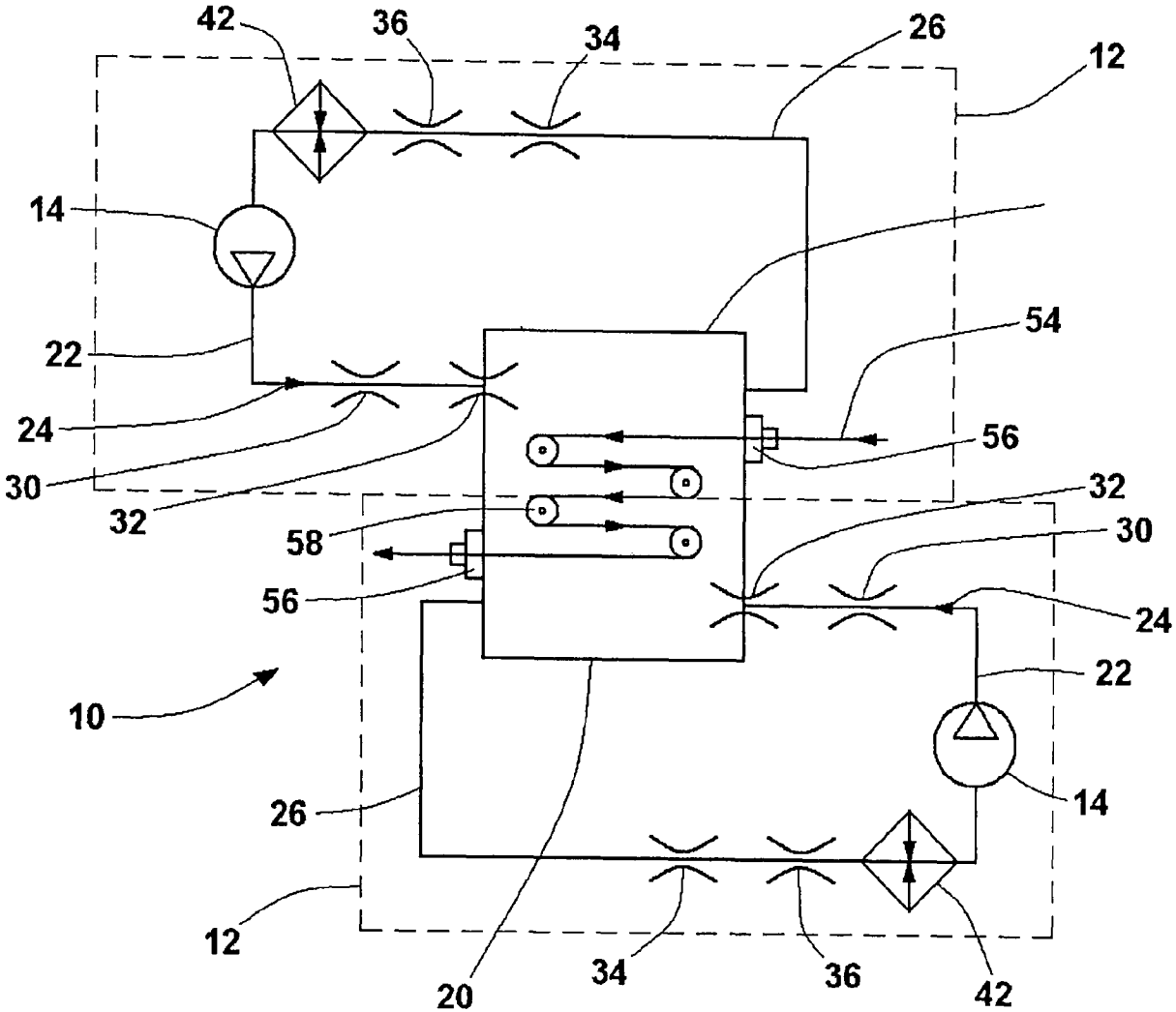
FIG. 3 shows, in a plan view, an equivalent circuit diagram for two hot-air furnace modules which are coupled to one another.

As can be inferred from the equivalent circuit diagram shown in FIG. 3, the adjacently arranged hot-air furnace modules 12 may be represented as a pneumatic system. The blower 14 acts as a pneumatic pump and opens into the incoming-air duct 22 which is provided with the first and second throttling devices 30, 32. The airstream then flows into the furnace chamber 20, which is formed by the two hot-air furnace modules 12. Through the furnace chamber 20 there is guided an endless filament 54 made of plastic, which is to be thermally oxidised and which passes into said furnace chamber 20 through a first sluice device 56 and passes out of said chamber 20 through a second sluice device 56. Within the furnace chamber 20, the filament 54 is rerouted a number of times by rerouting systems 58 in order to be thermally oxidised by the airstream. After flowing through the furnace chamber 20, said airstream passes into the used-air duct 26 through the third throttling device 34 and, after flowing through the fourth throttling device 36, passes through the heat-transfer device 42, where heating takes place. The airstream is then sucked into the blower box by the blower 14 and fed to the incoming-air duct 22 again.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A hot-air furnace module having a furnace chamber which is at least partially delimited by walls and with which there is associated an air-delivery device for producing an airstream and also a heat-transfer device for heating the airstream, wherein an incoming-air duct is provided which is constructed between the air-delivery device and the furnace chamber for directing the airstream delivered in one direction of flow by the air-delivery device and which is provided with first and second throttling means which are arranged at a distance from one another in the direction of flow and which even out the airstream before it flows through the furnace chamber; and, wherein a sluice device is provided at least at one wall region of the furnace chamber and which is constructed for continuously feeding-in and/or conducting-away an endless material which is to be thermally treated in the furnace chamber is provided at at least one wall region of the furnace chamber.

2. The hot-air furnace module of claim 1, wherein the second throttling means, which is associated with the incoming-air duct, is constructed as a wall of the furnace chamber.

3. The hot-air furnace module of claim 2, wherein a used-air duct is provided which is connected downstream of the furnace chamber in the direction of flow and which at least partially feeds back to the air-delivery device the airstream which has been directed through the furnace chamber.

4. The hot-air furnace module of claim 3, wherein at least one throttling means for the airstream is provided in the used-air duct.

5. The hot-air furnace module of claim 4, wherein a first throttling means which is associated with the used-air duct is constructed as a wall of the furnace chamber.

6. The hot-air furnace module of claim 5, wherein the throttling means which are designed as walls of the furnace chamber are arranged in an opposed manner.

7. The hot-air furnace module of claim 6, wherein there is provided, between the walls which are designed as throttling means, at least one separating device for decoupling airstreams in the furnace chamber, which separating device has narrow slots for passing through filament-directing bars.

8. The hot-air furnace module of claim 1, wherein at least one throttling means is constructed as a wall which has clearances passing through it.

9. The hot-air furnace module of claim 8, wherein at least one of the throttling means is provided with air-directing means which are constructed as walls which are oriented orthogonally to a surface of said throttling means through which flow takes place.

10. The hot-air furnace module of claim 9, wherein a number of throttling means, with air-directing means, are arranged immediately one behind another in the direction of flow, and form throttling units.

11. The hot-air furnace module of claim 1, wherein the clearances in the throttling means are arranged at a distance from one another, and are constructed in such a way that said throttling means have flow-resistances for the airstream which differ.

12. The hot-air furnace module of claim 11, wherein the first throttling means has a lower flow-resistance than the second throttling means which is connected downstream in the direction of flow.

13. The hot-air furnace module of claim 11, wherein the first throttling means is constructed with a clear cross-section of between 20 and 30 percent of a surface area.

14. The hot-air furnace module of claim 11, wherein the second throttling means is constructed with a clear cross-section of between 5 percent and 10 percent of a surface area.

15. The hot-air furnace module of claim 1, wherein the throttling means are arranged in the incoming-air duct and/or the used-air duct at an angle to one another.

16. The hot-air furnace module of claim 1, wherein the air-delivery device, the incoming-air duct and the walls designed as throttling means are arranged in such a way that an airstream which is emitted by the air-delivery device is able to flow in a parallel direction but in counter-current to an airstream within the furnace chamber.

17. The hot-air furnace module of claim 1, wherein the air-delivery device and the throttling means are constructed in such a way that, within the furnace chamber, a laminar airflow with a substantially uniform velocity distribution with a maximum velocity variation over the cross-section of the furnace chamber of +/−10 percent at a velocity of 1.5 m/s.

18. The hot-air furnace having hot-air furnace modules of claim 1, wherein hot-air furnace modules which are arranged in an adjacent manner in each case are oriented in a manner rotated by 180 degrees in relation to one another and are connected to one another in a communicating manner.

19. The hot-air furnace of claim 18, wherein the hot-air furnace modules delimit a common, uninterrupted furnace chamber.

20. The hot-air furnace of claim 18, wherein the used-air ducts form a distributor chamber which is arranged downstream of the furnace chamber in the direction of flow and which provides a preferably equal distribution of airstreams from the furnace chamber to the air-delivery devices of the at least two adjacently arranged hot-air furnace modules.

21. A hot-air furnace module comprising:

a furnace chamber which is at least partially delimited by walls and with which there is associated an air-delivery device for producing an airstream;

a heat-transfer device for heating the airstream;

an incoming-air duct is provided which is constructed between the air-delivery device and the furnace chamber for directing the airstream delivered in one direction of flow by the air-delivery device and which is provided with first and second throttling means which are arranged at a distance from one another in the direction of flow and which even out the airstream before it flows through the furnace chamber;

a third throttling means located on an underside of the furnace chamber, wherein the first throttling means, second throttling means, and third throttling means are designed as throttling units being assembled from a number of perforated metal sheets which are arranged immediately one behind the other in the direction of flow; and, an air directing means associated with two upper perforated metal sheets.

* * * * *